United States Patent [19]

Marki et al.

[11] Patent Number: 4,538,312

[45] Date of Patent: Sep. 3, 1985

[54] PLAYPEN PAD COVER

[76] Inventors: Gabriella M. Marki, 2060 NE. Second Ave., Pompano Beach, Fla. 33060; Katalin Ross, 12710 SW. 197th Ter., Miami, Fla. 33183

[21] Appl. No.: 501,427

[22] Filed: Jun. 6, 1983

[51] Int. Cl.[3] ..... A47G 9/04

[52] U.S. Cl. ..... 5/499; 5/482

[58] Field of Search ..... 5/482, 424, 484, 490, 5/496, 498, 499; D6/595, 596, 601, 603, 605, 606

[56] References Cited

U.S. PATENT DOCUMENTS

| | | | |
|---|---|---|---|
| 880,524 | 3/1908 | Hauphoff | 5/490 |
| 2,446,396 | 8/1948 | Waranch | 5/490 |
| 2,629,112 | 2/1953 | Moore et al. | 5/484 |
| 2,884,652 | 5/1959 | Paolicelli | 5/490 |
| 4,445,242 | 5/1984 | Bowen | 5/484 |

FOREIGN PATENT DOCUMENTS

| | | | |
|---|---|---|---|
| 148769 | 2/1904 | Fed. Rep. of Germany | 5/490 |
| 1302636 | 7/1962 | France | 5/490 |
| 14056 | of 1906 | United Kingdom | 5/490 |

*Primary Examiner*—Alexander Grosz

*Attorney, Agent, or Firm*—Melvin K. Silverman

[57] ABSTRACT

There is disclosed is a reversible fitted playpen pad cover including an upper panel having a rectangular area which is the same as the area of the floor of the playpen; a lower panel having the same area and shape as the upper panel in which the lower panel is secured to the upper panel along three of four mutual edges of the panels. This arrangement leaves an unclosed edge between the upper and lower panels and, thus, defines a flexible closure therebetween. There is also provided a rectangular lip panel which integrally depends from the upper panel along the unclosed edge of the upper panel. The lip panel is folded into the volume of the closure between the upper and lower panels and, along its opposite left and right edges that extend from the line of dependency with said upper panel, is secured between the upper and lower panels. The width of said lip panel extends over about one-third of the width of the entire playpen pad cover. Through this structure, a playpen pad may be readily fitted under said lip panel and between the lip panel and the upper panel, thus effectuating the firm securement of the playpen pad into the playpen cover. The resulting structure is also wholly reversible.

8 Claims, 6 Drawing Figures

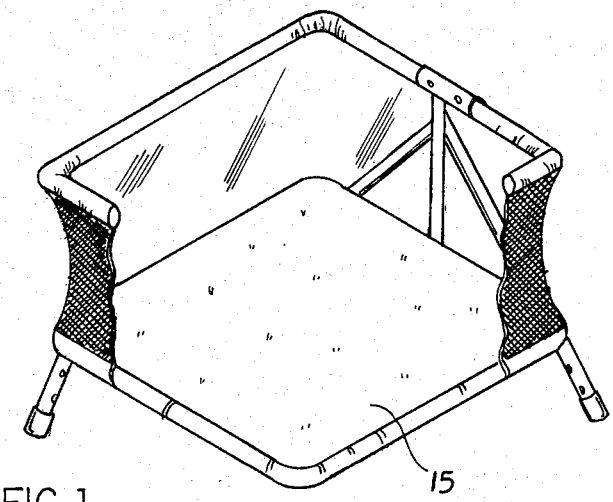
FIG. 1
FIG. 2
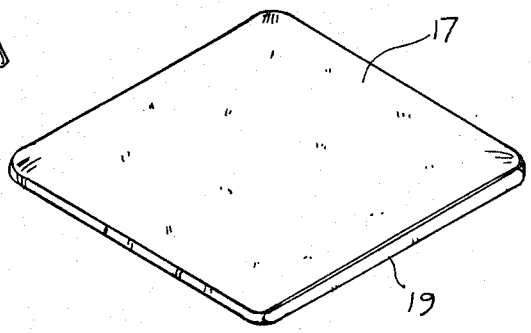
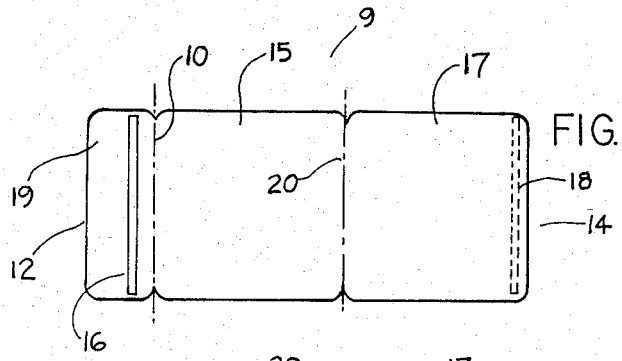
FIG. 3
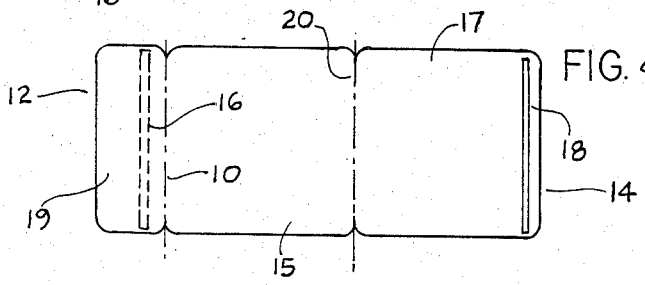
FIG. 4
FIG. 5
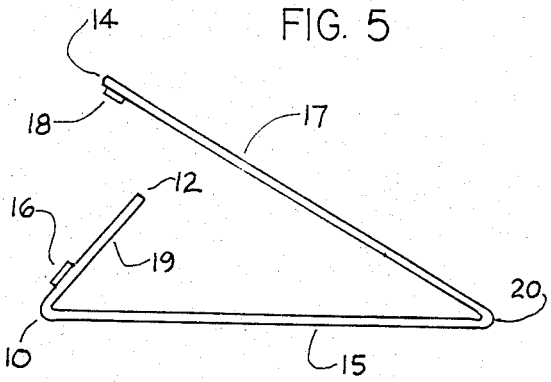
FIG. 6
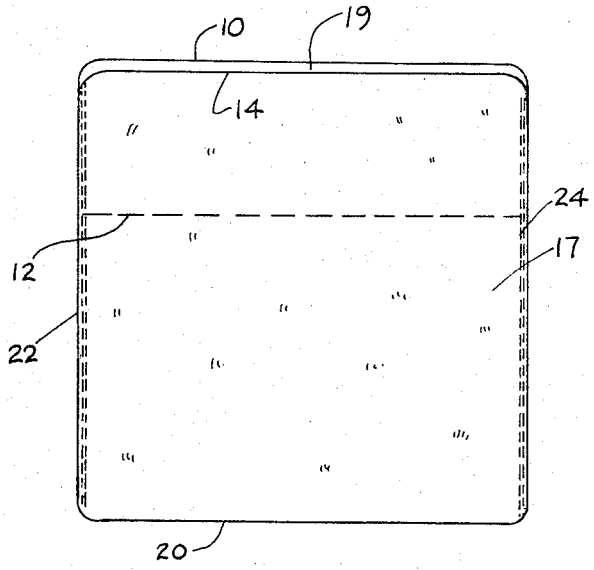

PLAYPEN PAD COVER

BACKGROUND OF THE INVENTION

The invention relates generally to a cover for a playpen pad and, more particularly, to one which is readily reversible, easily removed, and simply constructed.

Playpen pads that are presently used suffer from a variety of problems both in terms of the needs of the baby, the mother, and the manufacturer of the product. Typically, playpen pads are usually constructed of a thin plastic skin filled with a foam or other suitable material. The covers of these pads are subjected to a great deal of wear and tear in daily use. As a consequence of such treatment, the plastic tends to crack and tear. Moreover, the plastic is difficult to clean since it is an integral part of the playpen pad. In order to properly clean the plastic skin, the entire pad must be removed from the playpen. The pad is generally not accessible in any other way.

Another shortcoming of the use of a plastic skin to cover a playpen pad lies in the fact that it tends to warp when subjected to heat, thus becoming sticky and uncomfortable for the baby. Also, in the use of a plastic cover, cold and wet spots are impossible to avoid and the baby may, therefore, become chilled and chafed by contact with the plastic. Because of this, another shortcoming is that it becomes highly desirable to clothe the playpen pad with a suitable cover; however, no such cover is available in the marketplace for mass marketing and mass use purposes. It is, accordingly, as a response to the above set forth needs that the present invention may be viewed.

The present invention is believed properly classified in U.S. Class 5, Sub-classes 485, 495, 496, 497 and 502. The most pertinent art known to the Applicant is U.S. Pat. No. 2,817,858 which pertains to a slip cover for a playpen pad. This pad cover relates to a type of playpen that is now obsolete.

SUMMARY OF THE INVENTION

The present invention is a reversible fitted playpen pad cover comprising: an upper panel having a rectangular area which is the same as the area of the floor of the playpen; a lower panel having the same area and shape as said upper panel in which said lower panel is secured to the upper panel along three of four mutual edges of said panels. This arrangement leaves an unclosed edge between said upper and lower panels and, thus, defines a flexible closure therebetween. There is also provided a rectangular lip panel which integrally depends from the upper panel along the unclosed edge of said upper panel. The lip panel is folded into the volume of the closure between said upper and lower panels and, along its opposite left and right edges that extend from the line of dependency with said upper panel, is secured between the upper and lower panels, thereby leaving an unclosed edge of the lip panel within the flexible closure defined by the upper and lower panels. The width of said lip panel comprises about one-third of the width of the entire playpen pad cover. Through this structure, a playpen pad may be readily fitted under said lip panel and between the lip panel and the upper panel, thus effectuating the firm securement of the playpen pad into the playpen cover. The resulting structure is also wholly reversible.

It is consequently one object of the present invention to provide a fitted, reversible playpen pad cover in which the pad can be easily inserted into, or removed from, the pad cover and yet which will not slip or shift in position when the cover is properly fitted to the pad.

It is another object of the invention to provide a contour cover for playpen pads which can be removed and washed without necessitating the removal of the entire pad from the floor of the playpen.

It is yet another object to provide a contour cover for playpen pads which will not chafe or irritate the baby's skin, and which would be safe even if the baby were to slip underneath the pad cover.

It is a still further object to provide a cloth cover for playpen pads which is simple to manufacture, durable and yet attractive.

Still further objects and advantages of this invention will become apparent from the hereinafter set forth Detailed Description of the Invention, the Drawings, and the Claims appended herewith.

BRIEF DESCRIPTION OF THE DRAWINGS

FIG. 1 is a perspective view of the playpen cover disposed within a typical playpen.

FIG. 2 is a perspective view of the lower panel of the pad cover showing a portion of the lip panel of the cover.

FIG. 3 is a front view of the pattern for the present playpen pad cover showing the preferred location of the fold lines and Hook and Loop Type Fastening strips.

FIG. 4 is a plan view of the reverse side of the pattern shown in FIG. 3.

FIG. 5 is a schematic edge view of the pad cover pattern showing an intermediate step in the fabrication of the cover from the pattern.

FIG. 6 is a schematic view of the lower panel, similar to the perspective view of FIG. 2, however, showing the stitching arrangement between the lip panel and the other panels of the cover.

DETAILED DESCRIPTION OF THE INVENTION

In FIG. 1 the playpen pad cover is shown as it would appear when resting in a conventional mesh-type playpen. The side of the playpen pad appearing in FIG. 1 is hereinafter referred to as upper panel 15. The reverse of upper panel 15 is shown in FIG. 2 in which there is illustrated a lower panel 17 as well as a segment of a lip panel 19.

In FIG. 3 is shown the pattern from which the present inventive reversible fitted playpen pad is formed. In particular, the pattern comprises a large sheet 9 of a material adapted to cover a pad. The sheet 9 is substantially rectangular and comprises a first cross-sectional edge 12 and a second cross-sectional edge 14. There is also shown vertical fold lines 10 and 20 which separate the pattern into lip panel 19, upper panel 15, and lower panel 17. The ratio of the horizontal width of said panels is 1:3:3, this meaning that the horizontal (as the pattern appears in FIGS. 3 and 4) width of the lip panel is about one-third the horizontal width of the upper panel and, similarly, about one-third the width of the lower panel. More particularly, such ratio of widths has been found to fall desirably in the range of 20 to 30 percent.

Also shown in FIG. 3 is the location of a first Hook and Loop Type Fastening strip 16 which is vertically disposed within the lip panel 19, and a second Hook and Loop Type Fastening strip 18 which is vertically disposed upon the lower panel 17. It is to be noted that the Hook and Loop Type Fastening strip 18 is placed on the opposite planar side of the pattern from the first Hook and Loop Type Fastening strip 16. These Hook and Loop Type Fastening strips constitute means for securing the lip panel 19 to the lower panel 17 after the pad has been (as hereinafter described) inserted into the pad cover.

The hook and loop type fastening strips mentioned above may be of the type that are sold under the trademark of Velcro.

In FIG. 4 is shown the reverse side of the pattern that is illustrated in FIG. 3. Accordingly, the reverse of the pattern differs from the front only in that the second Hook and Loop Type Fastening strip 18 becomes visible from the back while the first Hook and Loop Type Fastening strip 16 is not visible.

The first step in the assembly of the pattern of sheet 9 is illustrated in FIG. 5 in which the pattern is shown partially folded along its fold lines 10 and 20 with the front panel 15 of the pattern shown at the bottom of the figure. The lip panel 19 is shown at the left and the lower panel 17 is shown as the right leg of the semi-triangular partially folded pattern in FIG. 5. The Hook and Loop Type Fastening strips 16 and 18 are shown as they would appear just prior to mating with each other.

The net step in the assembly of the pattern is shown in FIG. 6 in which fold line 10 appears at the top of the figure and fold line 20 appears at the bottom of the figure. The ends 12 and 14 of the pattern are also shown. Therein it is noted that the end 12 of the lip panel 19 extends underneath the lower panel 17 but, however, above the upper panel 15 (not shown). Therefore, the stitching 22 and 24 will concurrently secure all three panels within the same two-dimensional plane. However, the end 14 will be unsecured such that the playpen pad can be fitted under end 14 of the lower panel 17 but above the lip panel 19. After the pad has been inserted between lower panel 17 and the lip panel 19, the lower portion of the pad is tucked under the end 12 of the lip panel 19 so that it fits between the lip panel and the upper panel 15. Thusly, after the pad has been tucked behind the end 12 of the lip panel, the lower one-third of the lower panel 17 will rest directly on the lip panel 19 while the other two-thirds of the lower panel 17 will rest directly upon the playpen pad. All of the upper panel 15 will rest against the playpen pad.

The completed structure, shown in FIG. 6, is wholly suitable for reversability of the pad and cover. As a result, the time between needed changes of the playpen pad cover is increased in that the cover and pad (as a unit) can simply be reversed when one side becomes soiled. Additionally, it is to be noted that the corners of the pad cover may be curved (see FIGS. 2, 3, 4 and 6) in order to attain a snugger fit of the pad and cover into the frame of the playpen.

In order to remove the pad from the cover, one need only pull the edges of the cover, pulling stitching 22 and 24 toward each other while pulling the edge 12 downward in the direction of fold 10. It has been found that this is all that is needed in order to accomplish the removal of the pad from the cover. Further, it has been discovered that the particular width of the lip panel with reference to the entire width of the pad, namely, a ratio in widths of about 1:3, has been found to be ideal for the purpose of retaining the pad firmly and securely within the cover while permitting ease of removal of the pad from the cover. Through experimentation, it has been found that a much greater ratio of width of the lip panel to width of the entire pad will render too difficult the removal of the pad from the cover while a ratio of width of less than twenty percent of the lip panel to the overall width of the cover will permit the pad to escape too easily from the cover and, in general, will not afford a stable combination of pad and cover for the baby to romp on.

The pair of Hook and Loop Type Fastening strips 16 and 18 serve to desirably secure the lower panel to the lip panel while the pad and pad cover are in use. When it is necessary to remove the cover, the Hook and Loop Type Fastening strips are easily separated. Hence, the use of said Hook and Loop Type Fastening strips as a securing means further enhances the practicality of the present invention.

The sheet is a light cotton-type fabric, which also makes it safe for a child; even if the child were to slip underneath the sheet, the child could breathe easily under it and the child could not strangle itself. The Hook and Loop Type Fastening would be added to seal off the sheet for safety; this way the child could not slip under it. This is an additional safety precaution in that the Hook and Loop Type Fastening strips make the sheet tight enough such that it is unlikely that a child could crawl under it.

The fabric used is washable, preferably cotton and, therefore, economical. If the child is sick, the germs would normally be trapped in the plastic covering, whereas with a cotton sheet, it can be easily washed, thus avoiding the spread of germs and rashes. A plastic covering must be scrubbed; the cotton sheet can be thrown in the washing machine.

The structure of the sheet for the pad is 38 by 40 inches in length with finished-off edges having a fold that would cover nearly one-third of the pad, once it is folded. It is a three-fold arrangement, one on top of the other. On a 36 inch square pad, the upper panel would be approximately 35½" the lower panel would be 36½". This second layer would completely cover the bottom of the pad.

The major function of the sheet is protection for the child. It is usual to put some sort of fabric (quilt, blanket, etc.) on the pad to protect the child, however, nothing completely covers the plastic pad for full protection. This cover would achieve that function while assuring that the paid will not slip or shift in position, thus making it impossible for the baby to get entangled in the cover.

While there has been shown and described the preferred embodiments of the present invention, it will be understood that the invention may be embodied otherwise than as herein specifically illustrated or described, and that within such embodiments certain changes in the detail and construction, and the form and arrangement of the parts, may be without departing from the underlying idea or principle of this invention within the scope of the appended claims.

Having thus described our invention, what we claim as new, useful and nonobvious, and, accordingly secure by Letters Patent of the United States is:

1. A reversible, fitted playpen pad cover for use on a playpen pad for a playpen, the playpen having substantially vertical walls and a floor, the playpen cover comprising:

(a) an upper panel of fabric having a rectangular area substantially the same as the area of the floor of said playpen;

(b) a lower panel of fabric having substantially the same area and shape as that of said upper panel, said lower panel integrally secured to said upper panel along three of four respective edges of said upper and lower panels, thereby leaving one unclosed pair of edges between said panels, thus defining a flexible closure length between said upper and lower panels;

(c) a rectangular lip panel of fabric integrally depending from said upper panel along the unclosed edge thereof, said lip panel foldable into said closure between said upper and lower panels, said lip panel having two edges that extend transversely from the line of dependency with said upper panel secured between said upper and lower panels along the two secured parallel edges of said upper and lower panels, thereby leaving one closure defined by said upper and lower panels, in which the width of said lip panel comprises between twenty and thirty-five percent of the width of said upper panel;

(d) means for resealably sealing the unclosed side of said lower panel, to the side of said lip panel opposite to said lower panel along substantially the entire closure lengths of said panels, whereby a playpen pad may be readily fitted under said lip panel and between said lip panel and said upper panel, thereby effectuating a firm securement of the playpen pad into said playpen cover which, after insertion of the pad thereinto, is wholly stable and completely reversible and is inaccessible to an infant.

2. The playpen pad cover as recited in claim 1 in which said securing means comprises:

a pair of hook and loop type fastening strips placed on opposing sides of said lower and lip panels parallel to and near the unclosed edges thereof.

3. The playpen pad cover as recited in claim 1 in which the corners of the pad cover are rounded.

4. The playpen pad cover as recited in claim 1 in which said rectangular panels comprise square panels suitable for use with a square pad.

5. A reversible, fitted playpen pad cover for use on a playpen pad for a playpen, the playpen having substantially vertical walls and a floor, the playpen cover comprising:

(a) an upper panel of fabric having a rectangular area substantially the same as the area of the floor of said playpen;

(b) a lower panel of fabric having substantially the same area and shape as that of said upper panel, said lower panel integrally secured to said upper panel along three of four respective edges of said upper and lower panels, thereby leaving one unclosed pair of edges between said panels, thus defining a flexible closure length between said upper and lower panels; and (c) a rectangular lip panel of fabric integrally depending from said upper panel along the unclosed edge thereof, said lip panel foldable into said closure between said upper and lower panels, said lip panel having two edges that extend transversely from the line of dependency with said upper panel, secured between said upper and lower panels along the two secured parallel edges of said upper and lower panels, thereby leaving one closure defined by said upper and lower panels, in which the width of said lip panel comprises a width between twenty and thirty-five percent of the width of said upper panel, said width dimension exceeding the possible reach of a human infant;

(d) means for resealably sealing the unclosed side of said lower panel, to the side of said lip panel opposite to said lower panel along substantially the entire closure lengths of said panels, whereby a playpen pad may be readily fitted under said lip panel and between said lip panel and said upper panel, thereby effectuating a firm securement of the playpen pad into said playpen cover which, after insertion of the pad thereinto, is wholly stable and completely reversible and is inaccessible to an infant.

6. The playpen pad cover recited in claim 5 in which said securement means comprises:

a pair of hook and loop type fastener strips placed on opposite sides of said lower lip panels, parallel to and near the unclosed edges thereof.

7. The playpen pad cover as recited in claim 5 in which the corners of said pad cover are rounded.

8. The playpen pad cover as recited in claim 5 in which said rectangular panels comprise square panels suitable for use with a square pad.

* * * * *